US007596327B2

(12) United States Patent
Kamimura

(10) Patent No.: US 7,596,327 B2
(45) Date of Patent: Sep. 29, 2009

(54) DEVELOPING CARTRIDGE AND IMAGE FORMING APPARATUS

(75) Inventor: Naoya Kamimura, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 59 days.

(21) Appl. No.: 11/526,599

(22) Filed: Sep. 26, 2006

(65) Prior Publication Data

US 2007/0140743 A1 Jun. 21, 2007

(30) Foreign Application Priority Data

Sep. 28, 2005 (JP) ..... 2005-282341

(51) Int. Cl.
*G03G 15/00* (2006.01)
*G03G 15/08* (2006.01)

(52) U.S. Cl. ..... 399/12; 399/13; 399/254

(58) Field of Classification Search ..... 399/12, 399/13, 262, 263, 256, 88
See application file for complete search history.

(56) References Cited

U.S. PATENT DOCUMENTS 4,952,976 A * 8/1990 Katoh et al. ..... 399/27
5,634,169 A * 5/1997 Barry et al. ..... 399/12
2001/0050706 A1* 12/2001 Ishii ..... 399/27 X
2006/0051110 A1* 3/2006 Koyama ..... 399/27
2006/0188273 A1* 8/2006 Takesawa et al. ..... 399/27
2006/0193644 A1* 8/2006 Takagi ..... 399/12

FOREIGN PATENT DOCUMENTS

JP 07-028321 A * 1/1995
JP 09-127779 A * 5/1997
JP 11-084850 A * 3/1999
JP 2004-191559 7/2004
JP 2005-099434 A * 4/2005

OTHER PUBLICATIONS

Machine translation of JP 11-084850 A dated Mar. 8, 2008.*
Machine translation of JP 2005-099434 A dated Mar. 8, 2008.*
Office Action in corresponding Chinese Application No. 200610141633X.

* cited by examiner

*Primary Examiner*—Sophia S Chen
(74) *Attorney, Agent, or Firm*—Banner & Witcoff, Ltd.

(57) ABSTRACT

A developing cartridge that includes: a developer container that contains a developer; a developer carrier that carries the developer; an agitation member that includes a rotary shaft, agitates the developer in the developer container and supplies the developer to the developer carrier; a drive member that is provided at one end of the rotary shaft and transmits a driving force to the rotary shaft; and a detected portion that is provided at the other end of the rotary shaft.

19 Claims, 15 Drawing Sheets

DEVELOPING CARTRIDGE AND IMAGE FORMING APPARATUS

CROSS REFERENCE TO RELATED APPLICATION

This application claims priority from Japanese Patent Application No. 2005-282341, filed on Sep. 28, 2005, the entire subject matter of which is incorporated herein by reference.

TECHNICAL FIELD

Aspects of the present invention relate to a developing cartridge equipped with an agitation member and an image forming apparatus.

BACKGROUND

Heretofore, an image forming apparatus such as a laser printer, to which a developing cartridge containing a developer (hereafter referred to as a toner) can be detachably attached, has been known. Normally, the developing cartridge is equipped, in a developer container for containing the toner, with an agitation member (hereafter referred to as an agitator) for agitating the toner and supplying the toner to a developer carrier (hereafter referred to as a developing roller).

The agitator includes a rotary shaft and a plate-like agitation portion projecting from the rotary shaft in a direction perpendicular to the rotary shaft.

Both ends of the rotary shaft are rotatably supported on a developing cartridge casing sidewall forming the developer container. Particularly, one end of the rotary shaft is provided in such a way as to pass through the casing sidewall, and a drive member (hereafter referred to as a gear) for transmitting a driving force to the rotary shaft is fixed to the pass-through portion.

Also, the gear is provided with a detected portion for causing a detector portion disposed in an image forming apparatus to detect a rotary condition of the rotary shaft (for example, refer to JP-A-2004-191559).

In the thus configured developing cartridge, by the rotary shaft and thus the agitation portion of the agitator rotating in response to a driving force from the image forming apparatus via the gear, the toner in the developer container is agitated and supplied to the developing roller. Furthermore, the rotary condition of the rotary shaft is detected by the detector portion via the detected portion.

SUMMARY

Meanwhile, in such a developing cartridge and image forming apparatus, in the event that they are kept in the same condition for a long period of time, the toner contained in the developer container may coagulate. When the agitator is activated with the toner coagulated in this way, the agitation portion undergoes a large resistance, whereby a large load is applied to a portion provided with the gear of the rotary shaft (hereafter referred to as a gear installation portion) and, in some cases, the rotary shaft of the agitator is broken in the vicinity of the gear installation portion (as used herein, the breaking, including a fracture of the rotary shaft, refers to a condition in which the rotary shaft cannot rotate normally).

Then, in the event that the rotary shaft of the agitator is thus broken and the agitation portion does not function adequately, a supply of the toner to a supply roller and thus the developing roller becomes insufficient or unstable, giving rise to a factor which causes a defective printing.

However, in the apparatus disclosed in JP-A-2004-191559, even though an abnormality occurs in which the rotary shaft of the agitator is broken, the gear provided with the detected portion, in response to the driving force supplied from the image forming apparatus, continues to rotate regardless of an operation of the agitation portion. Therefore, there is a problem in which it is impossible to cause the detector portion of the image forming apparatus to detect such an abnormality.

Aspects of the invention provide a developing cartridge and an image forming apparatus, which can reliably detect a breaking of an agitator.

DETAILED DESCRIPTION

[General Overview]

Figure 1:
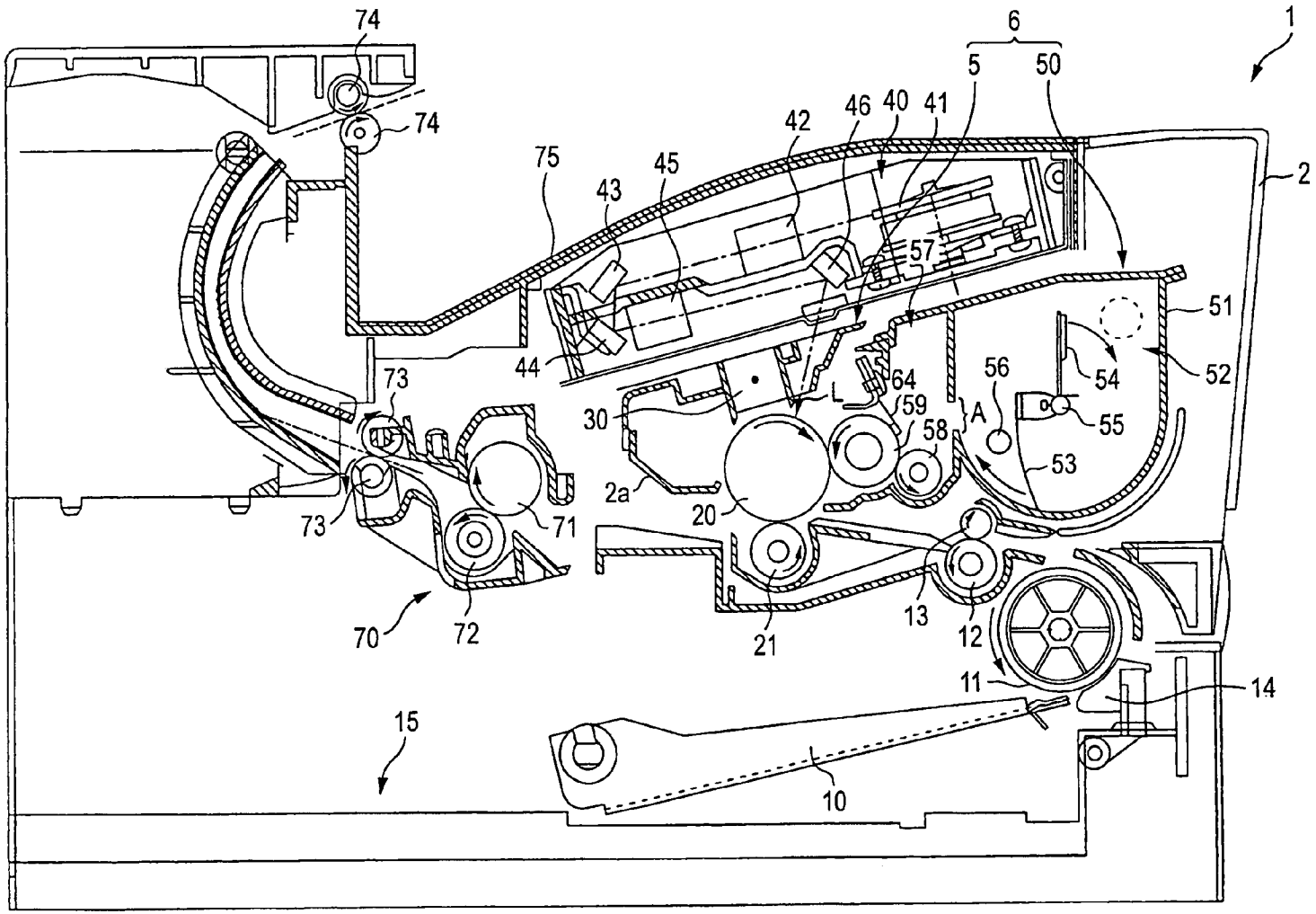
FIG. 1 is a sectional view showing an outline of an image forming apparatus.

According to a first aspect of the invention, there is provided a developing cartridge comprising: a developer container that contains a developer; a developer carrier that carries the developer; an agitation member that comprises a rotary shaft, agitates the developer in the developer container and supplies the developer to the developer carrier; a drive member that is provided at one end of the rotary shaft and transmits a driving force to the rotary shaft; and a detected portion that is provided at the other end of the rotary shaft.

In the thus configured developing cartridge, in a case in which the rotary shaft rotates normally, the detector portion, via the detected portion, detects the rotary condition of the rotary shaft synchronized with an operating condition of the drive member.

However, in the event that the rotary shaft of the agitation member is broken on an attachment end side of the drive member (the breaking, including a fracture of the rotary shaft, refers to a condition in which the rotary shaft cannot rotate normally), the driving force from the drive member is not transmitted to an installation end side of the detected portion, and the detected portion is placed in a different operating condition from that of the drive member, such as a condition in which the detected portion stops operating.

Consequently, according to the developing cartridge, by comparing the drive condition of the drive member and the operating condition of the detected portion, it is possible to reliably detect the breaking of the agitation member.

According to a second aspect of the invention, the developing cartridge is configured to be installed in an image forming apparatus comprising a detector, and wherein the detected portion is detected by the detector when the developing cartridge is installed in the image forming apparatus.

Also, according to a third aspect of the invention, the detected portion is a rotary member that is rotated by a rotation of the rotary shaft.

According to the thus configured developing cartridge, even without converting the rotary movement of the rotary shaft into another movement (for example, a reciprocating movement), it is possible to detect the rotary condition of the rotary shaft (that is, the breaking of the agitation member). Consequently, a structure of the detected portion can be simplified.

Furthermore, according to a fourth aspect of the invention, the detected portion is integrally formed with the rotary shaft.

According to the thus configured developing cartridge, as the rotation of the rotary shaft is directly transmitted to the detected portion, it is possible to more reliably detect the breaking of the agitation member.

As used herein, the integral formation includes both a configuration in which the detected portion molded separately from the rotary shaft is directly connected to the rotary shaft and a configuration in which the rotary shaft and the detected portion are integrally molded.

Next, according to a fifth aspect of the invention, the detected portion comprises a phase information provision portion that contributes to detect that a rotation phase of the rotary shaft falls in a preset reference phase.

According to the thus configured developing cartridge, information (that is, the reference phase) for specifying the rotation phase of the rotary shaft and thus the position of the agitation portion can be provided to an exterior (that is, the image forming apparatus) via the detected portion.

Then, according to the image forming apparatus having attached thereto the developing cartridge, by controlling the drive of the drive member based on a result of the detection in the detector portion, the agitation portion etc. of the agitation member can be stopped in an appropriate position (for example, a position which does not remain under a pressure from the developer).

Also, according to a sixth aspect of the invention, the detected portion comprises a loading amount information provision portion that contributes to detect detection signals differing according to an initial loading amount of the developer contained in the developer container According to the thus configured developing cartridge, information on the initial loading amount of the developer contained in the developer container can be provided to the exterior (that is, the image forming apparatus) via the detected portion.

Then, according to the image forming apparatus having attached thereto the developing cartridge, it becomes possible, based on the detection result from the detector portion, to identify a type (that is, the initial loading amount of the developer) of the developing cartridge attached to the image forming apparatus.

It is also acceptable that the loading information provision portion is one combined with the phase information provision portion of the fourth aspect.

Also, according to a seventh aspect of the invention, the detected portion comprises a type information provision portion that contributes to detect detection signals differing according to a type of the developer contained in the developer container According to the thus configured developing cartridge, information on the type of the developer contained in the developer container can be provided to the exterior (that is, the image forming apparatus) via the detected portion.

It is also acceptable that the type information provision portion is one combined with either or both of the phase information provision portion of claim 4 and the loading information provision portion of the fifth aspect.

Next, according to an eighth aspect of the invention, there is provided an image forming apparatus comprising: a developing cartridge that comprises: a developer container that contains a developer; a developer carrier that carries the developer; an agitation member that comprises a rotary shaft, agitates the developer in the developer container and supplies the developer to the developer carrier; a drive member that is provided at one end of the rotary shaft and transmits a driving force to the rotary shaft; and a detected portion that is provided at the other end of the rotary shaft; a drive section that supplies the driving force to the drive member; a detector portion that detects a rotary condition of the rotary shaft via the detected portion; and a drive control section that controls an operation of the drive section when forming an image and comprises an abnormal stop section that stops the drive section if the operation of the drive section does not match with a result of the detection by the detector portion.

According to the thus configured image forming apparatus, the drive section can be prevented from remaining in operation (as used herein, the operation includes a roller drive which is carried out for a printing) with the rotary shaft of the agitation member being broken, making it possible to suppress an occurrence of a defective printing.

Meanwhile, in a case of a normal operation stop, when the agitation member is stopped in a position in which the agitation portion of the agitation member makes contact with the developer, the agitation member being stopped is deformed by remaining under the pressure from the developer, and may become unable to fulfill its own role.

In order to solve such a problem, according to a ninth aspect of the invention, the detected portion comprises a phase information provision portion that causes the detector portion to detect that a rotary phase of the rotary shaft falls in a preset reference phase, and the drive control section comprises a stop control section that, when stopping the operation of the drive section, stops the agitation member in a preset stop position by controlling the drive section based on the result of the detection by the detector portion in such a way that the rotary shaft stops at a stop phase having a predetermined relationship with the reference phase.

According to the thus configured image forming apparatus, as an unnecessary pressure is prevented from remaining applied to the agitation member being stopped, this member can be prevented from being deformed and, as a result, a useful life of the agitation member can be increased.

Also, according to a tenth aspect of the invention, the developing cartridge has a loading hole that is for loading the developing cartridge with the developer and is provided on an end side of the rotary shaft of the agitation member, and the stop position is set outside an opening area of the loading hole in a direction along the rotary shaft of the agitation member.

According to the thus configured image forming apparatus, as a loading nozzle can be smoothly inserted via the loading hole, a replenishment of the developer can be easily carried out.

Next, according to an eleventh aspect of the invention, the detected portion comprises a loading amount information provision portion that causes the detector portion to detect detection signals differing according to an initial loading amount of the developer contained in the developer container, and the image forming apparatus further comprises a use detection section that detects whether or not the developing cartridge is unused and a use period setting unit that, if a result of the detection by the use detection section is that the developing cartridge is unused, sets information on a use period of an attached developing cartridge in accordance with a pattern of the detection signal detected by the detector portion.

According to the thus configured image forming apparatus, the use period of the developing cartridge can be set according to the type of the developing cartridge (for example, a cartridge before shipment, a replacement cartridge or the like). As a result, a printing using a deteriorated developer can be prevented, making it possible to suppress a defective printing.

The use period refers to a period of time for which the developer can be used without any deterioration. Also, as information on the use period, specifically, it is possible to employ the number of revolutions of the rotary shaft (that is, the agitation portion), the number of copies printed in the image forming apparatus, or the like.

Also, according to a twelfth aspect of the invention, the detected portion comprises a type information provision portion that causes the detector portion to detect detection signals differing according to a type of the developer contained in the developer container, and the image forming apparatus further comprises a plurality of cartridge attaching portions which is provided according to the type of the developer and to each of which a developing cartridge is attached and an attachment position determination section that, in accordance with the pattern of the detection signal detected by the detector portion, determines whether or not the developing cartridge attached to the cartridge attaching portion is in an appropriate position.

According to the thus configured image forming apparatus, in the event that the developing cartridge is attached in an inappropriate position as a result of the determination by the attachment position determination means, by executing an inhibition of a printing process, an alarm process for a user, or the like, it is possible to prevent an abnormal printing execution based on an inappropriate attachment of the developing cartridge.

Also, according to a thirteenth aspect of the invention, the detector portion is used in a condition of non-contact with the detected portion.

With the thus configured image forming apparatus of the invention, the useful life of the detector portion can be lengthened.

Furthermore, according to a fourteenth aspect of the invention, a space on a movement path along which the detected portion moves when the developing cartridge is attached and detached is defined as a detected portion movement path, wherein the detector portion is disposed outside the detected portion movement path.

With the thus configured image forming apparatus, the developing cartridge can be easily attached to and detached from the image forming apparatus.

[One Aspect]

<Overall Configuration of Apparatus>

Aspects of the invention will hereafter be described with reference to the drawings.

FIG. 1 is a sectional view showing a schematic configuration of a laser printer 1, which is an image forming apparatus.

The laser printer 1 shown in FIG. 1 is equipped, at a bottom of a body casing 2, with a feeder unit 15 which feeds sheets of paper (not shown). The feeder unit 15, being equipped with a paper pressing plate 10 which is pressed by a not-shown spring, a paper feed roller 11 and a friction separation member 14, causes the paper pressing plate 10 to press the sheets of paper against the paper feed roller 11 and, between the paper feed roller 11 and the friction separation member 14, separates one sheet of paper from the others as the paper feed roller 11 rotates, thereby carrying out a paper feeding at a prescribed timing.

A pair of register rollers 12 and 13, being rotatably supported on a downstream side in a paper conveying direction of the paper feed roller 11, which rotates in a direction of the arrow in FIG. 1, conveys the sheet of paper at a prescribed timing to a transfer position between a photosensitive drum 20 and a transfer roller 21.

Also, an image forming section is equipped with a scanner unit 40, a process cartridge 6, a fixing unit 70 and the like.

Of them, the scanner unit 40 is equipped with a laser diode which is a light emitting element which emits a laser beam for forming an electrostatic latent image on the photosensitive drum 20, a polygon mirror 41 which is rotationally driven, an fθ lens 42 for focusing the laser beam, a toric lens 45, and reflecting lenses 43, 44 and 46. That is, the scanner unit 40 is configured in such a way that a laser beam which, being based on image data, is emitted from the laser diode, is deflected by the polygon mirror 41 then, after passing through the fθ lens 42, has an optical path changed by the reflecting mirrors 43 and 44 and, furthermore, after passing through the toric lens 45, has the optical path bent downward by the reflecting mirror 46, thereby being projected onto a surface of the photosensitive drum 20 by a high speed scanning.

The process cartridge 6, which is a cartridge having a configuration for carrying out an image forming process (charging, developing, transferring and cleaning (cleaning of a photosensitive drum)), below the scanner unit 40, is detachably attached to the body casing 2. The process cartridge 6 includes a drum cartridge 5 and a developing cartridge 50 which is a developing device and is detachably attached to the inner side of the drum cartridge 5.

The drum cartridge 5, having a configuration which allows the developing cartridge 50 to be attached thereto and detached therefrom, is configured in such a way that the photosensitive drum 20, a charger 30 and the transfer roller 21 are incorporated therein.

The photosensitive drum 20 to be irradiated with the laser beam, being made of an organic photosensitive containing mainly, for example, a positively chargeable polycarbonate, is rotatably supported on the body casing 2. The photosensitive drum 20, by having a driving force applied to a drive member (not shown) thereof, is rotatably driven in a direction of the arrow in FIG. 1.

The charger 30 is configured in such a way as to charge the photosensitive drum 20 by generating a corona discharge from a charging wire made of, for example, tungsten.

The transfer roller 21, including a conductive foamed elastic body made of silicon rubber, urethane rubber or the like, is rotatably supported. The transfer roller 21 is configured in such a way as to transfer a toner image on the photosensitive drum 20 to the sheet of paper as a voltage is applied to the transfer roller 21.

The fixing unit 70, being provided on a downstream side in the paper conveying direction of a pressure-contact portion between the photosensitive drum 20 and the transfer roller 21, is equipped with a heating roller 71 and a pressing roller 72. The toner image transferred to the sheet of paper, while being conveyed by the heating roller 71 and the pressing roller 72, is heated, pressed, and thereby fixed to the sheet of paper.

Also, a pair of conveying rollers 73 and a pair of paper discharge rollers 74, which are disposed for use in paper conveyance, are provided on a downstream side of the fixing unit 70 in the conveying direction, and a paper discharge tray 75 is provided on a downstream side of the paper discharge rollers 74.

Figure 3:
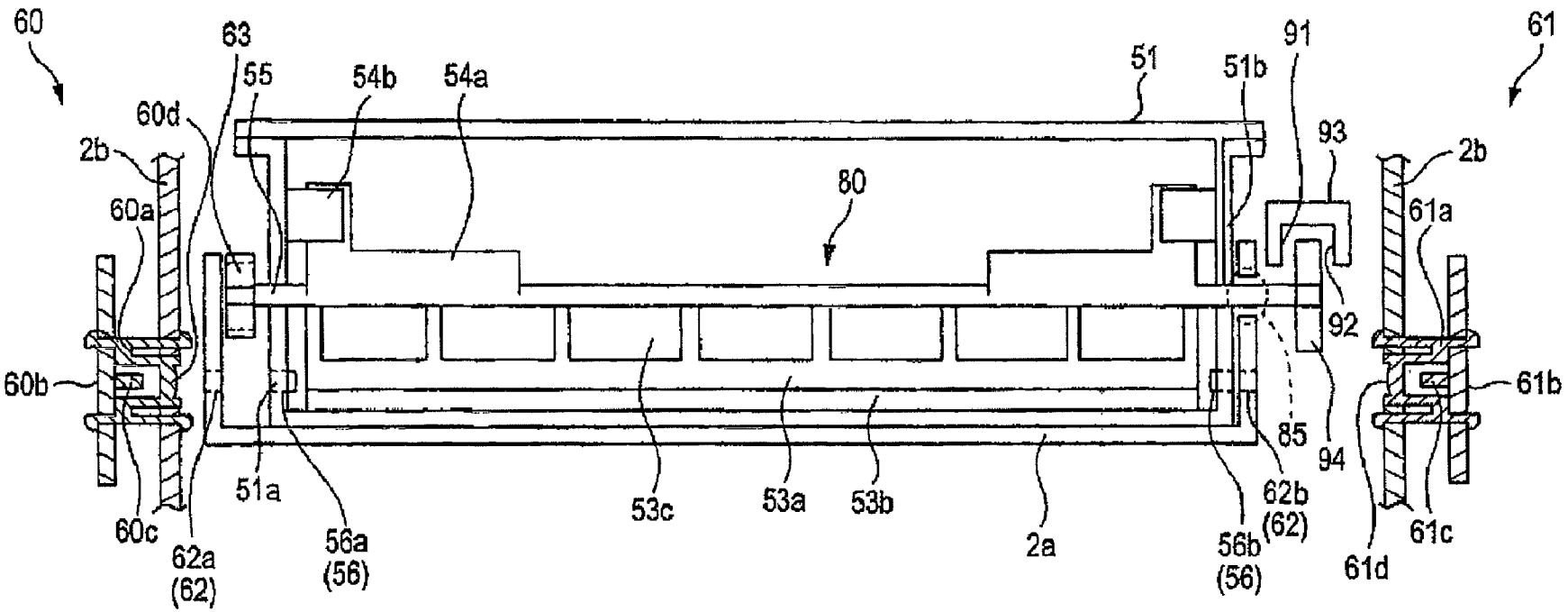
FIG. 3 is a sectional view taken along line X-X of FIG. 2.

The body casing 2 and the developing cartridge 50 are provided with a developer remaining amount detection mechanism described later for detecting a remaining amount of developer. As shown in FIG. 3, the developer remaining amount detection mechanism includes a sensor made up of a remaining amount detection light emitting portion 60 and a remaining amount detection light receiving portion 61 which are provided on the body casing 2, a light transmission window 56 provided in the developing cartridge 50, and an opening 62 provided in the drum cartridge 5.

The light transmission window 56, being a transparent or half transparent member formed from an acrylic resin or the like, includes a light transmission window 56*a* attached to a casing end wall 51*a* on the remaining amount detection light emitting portion 60 side of a casing 51, and a light transmission window 56*b* attached to a casing end wall 51*b* on the remaining amount detection light receiving portion 61 side. Furthermore, openings 62*a* and 62*b* are formed in positions corresponding to the light transmission windows 56*a* and 56*b* of the drum cartridge 5, and the remaining amount detection light emitting portion 60 and the remaining amount detection light receiving portion 61 are provided on both sides of the developing cartridge 50 in such a way as to correspond to positions in which the light transmission windows 56*a* and 56*b* are provided.

The remaining amount detection light emitting portion 60 includes a holder 60*a* attached to a frame 2*b* of the body casing 2, a substrate 60*b* supported on the holder 60*a*, and a light emitting element 60*c* provided on the substrate 60*b*. The holder 60*a* is formed from plastics, and aplastic lens 60*d* is formed by integral molding on a side of the holder 60*a* opposite the light transmission window 56*a*. A light emitting diode is employed as an example of the light emitting element 60*c*.

Also, as with the remaining amount detection light emitting portion 60, the remaining amount detection light receiving portion 61 includes a holder 61*a*, a substrate 61*b* and a light receiving element 61*c* provided on the substrate 61*b*. A phototransistor is employed as an example of the light receiving element 61*c*.

The heretofore described light emitting element 60*c*, plastic lens 60*d*, opening 62*a* of the drum cartridge 5, light transmission window 56*a*, light transmission window 56*b*, opening 62*b* of the drum cartridge 5, plastic lens 61*d* and light receiving element 61*c*, as shown in FIG. 3, are arranged on a substantially straight line, and are disposed in a position which does not overlap a detected portion 94 of a rotary shaft 55 to be described hereafter.

Consequently, in a condition in which no toner exists between the light transmission window 56*a* and the light transmission window 56*b*, the light emitting element 60*c* emits light, and the light transmitted through the light transmission window 56*a* is made incident on the light transmission window 56*b* on the opposite side and received by the light receiving element 61*c*. That is, the light receiving element 61*c* receives a light quantity corresponding to a remaining amount of toner.

<Configuration of Developing Cartridge>

Figure 2:
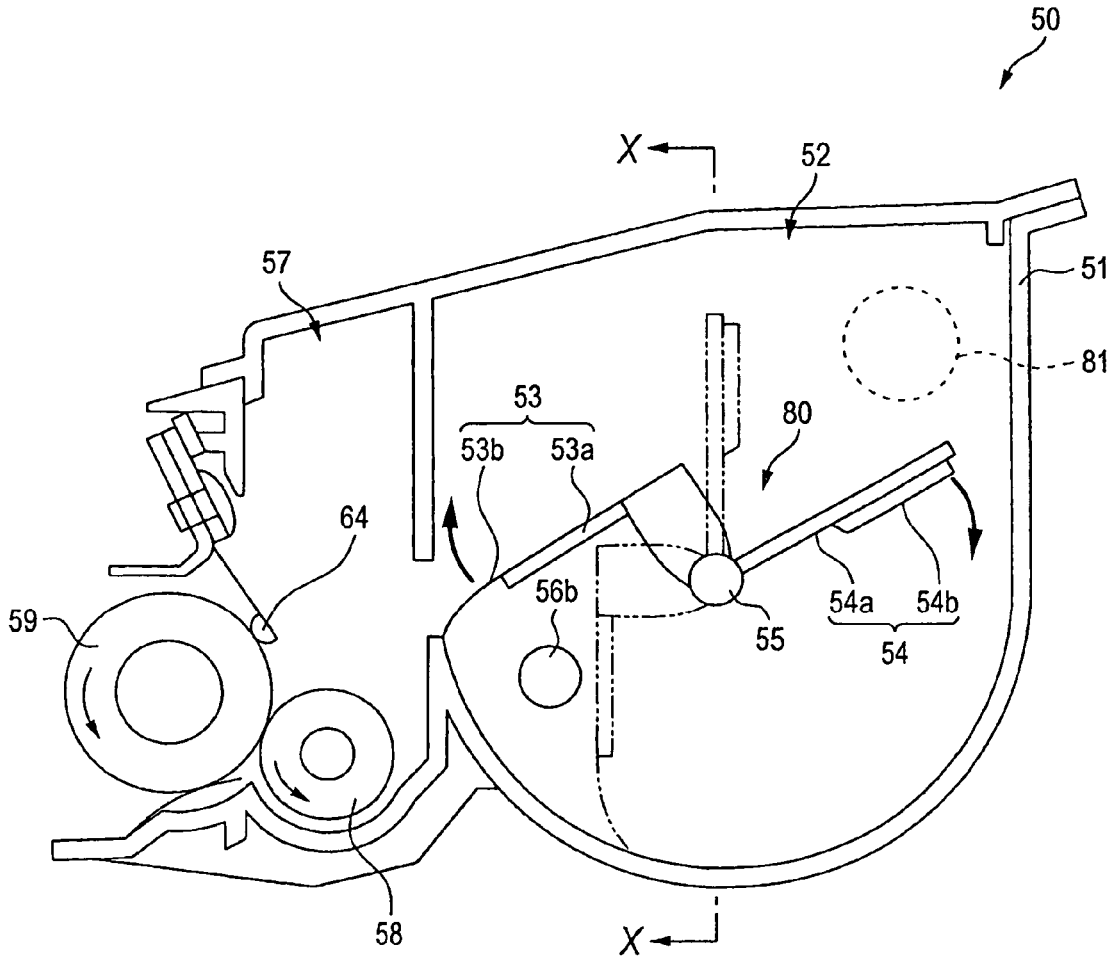
FIG. 2 is an enlarged view of a developing cartridge.

FIG. 2 is an enlarged view showing in enlarged form a portion of the developing cartridge 50, and FIG. 3 is a sectional view taken along line X-X of FIG. 2.

As shown in FIGS. 2 and 3, the developing cartridge 50 is equipped, in its casing 51, with a developer container 52 containing a toner (not shown), which is a nonmagnetic developer, and a developing chamber 57 for carrying out a development by causing the toner supplied from the developer container 52 to adhere to the photosensitive drum 20.

The supply roller 58 and the developing roller 59 which acts as a developer carrier and makes contact with both the supply roller 58 and the photosensitive drum 20 and supplies the photosensitive drum 20 with the toner supplied from the supply roller 58, are rotatably supported on the developing chamber 57. An elastic, thin plate-like blade 64 arranges the toner, which has been supplied from the supply roller 58 and has adhered to the developing roller 59, in a prescribed layer thickness. The toner supplied to the photosensitive drum 20 from the developing roller 59 constantly becomes a fixed amount.

An agitator 80, which is an agitation member, is provided in the developer container 52. Also, the heretofore described light transmission windows 56*a* and 56*b* are provided in the casing 51 end walls 51*a* and 51*b* forming sidewalls (wall surfaces extending along the plane of FIG. 2) of the developer container 52. A loading hole 81 for use in loading the developer container 52 with the toner is formed in one end wall 51*a*.

Of the above components, the agitator 80 includes the rotary shaft 55, both ends of which are rotatably supported on the casing 51 end walls 51*a* and 51*b*, an agitating portion 53 which agitates the toner contained in the developer container 52, and a cleaning portion 54 for cleaning the light transmission windows 56*a* and 56*b* formed in the casing end walls 51*a* and 51*b*.

The agitation portion 53 includes mainly an agitation body 53*a* for agitating the toner and a sliding contact portion 53*b* for conveying the toner to the developing chamber 57. Of them, the agitation body 53*a*, being an L-section member projecting from the rotary shaft 55, has a plurality of openings 53*c* formed in an agitation surface which agitates the toner. Also, the sliding contact portion 53*b*, being a sheet-like member formed from a flexible material (for example, PET: polyethylene terephthalate), is attached to a leading end of the agitation body 53*a*.

The cleaning portion 54 includes a wiper 54*b* for wiping off the toner adhering to the light transmission window 56 and a wiper support 54*b* for supporting the wiper 54*b*. Of them, the wiper support 54*a*, being a plate-like member formed projecting from the rotary shaft 55, is formed in such a way as to be perpendicular to an attachment end of the L-shaped agitation body 53*a*, which is attached to the rotary shaft, and parallel to the leading end of the agitation body 53*a*, to which the sliding contact portion 53*b* is attached. Also, the wiper support 54*a* has an amount of projection from the rotary shaft 55 set in such a way that, when rotating the agitator 80, a leading end portion of the wiper support 54*a* passes a position facing the light transmission window 56. The wiper 54*b*, being a member made of urethane rubber, is attached to the leading end portion of the wiper support 54*a* in such a way as to, when rotating the agitator 80, make sliding contact with a portion in which the light transmission window 56 is formed.

The rotary shaft 55, the agitation body 53*a* of the agitation portion 53, and the wiper support 54*a* of the cleaning portion 54 are integrally molded from a synthetic resin which has a strength necessary for agitating the toner.

Both the ends of the rotary shaft 55 are formed in such a way as to pass through the casing end walls 51*a* and 51*b*. A gear 63, which is a drive member for transmitting a driving force to the rotary shaft 55, is fixed to one end (hereafter referred to as a drive end) exposed to an outside of the casing end wall 51*a*. Also, a detected portion 94, which is for causing a detector portion 93 disposed in a laser printer 1 body to detect a rotary condition of the rotary shaft 55, is provided at the other end (hereafter referred to as a driven end) of the rotary shaft 55 which is exposed to an outside of the casing end wall 51*b*.

Also, rotary shafts of the supply roller 58 and the developing roller 59 are formed in such a way that one-end portions thereof pass through the casing end wall 51*a*, and gears 67 and 66 (refer to FIG. 5) are fixed respectively to ends of the supply roller 58 and the developing roller 59 which are exposed to the outside of the casing end wall 51*a*.

Figure 5:
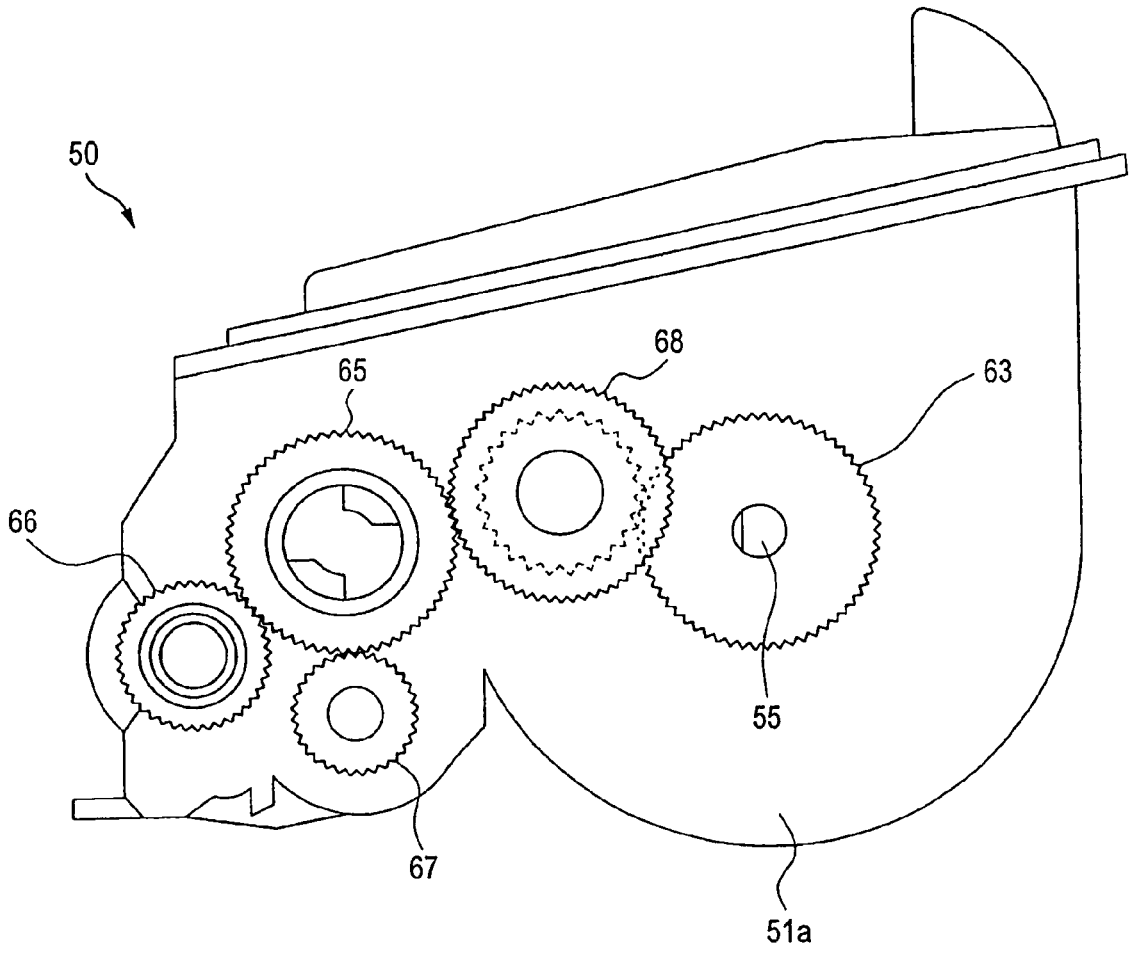
FIG. 5 is a configuration view showing a drive member.

FIG. 5 is an illustration schematically showing an outer surface of the casing end wall 51*a* (on the drive end side of the rotary shaft 55) of the developing cartridge 50.

As shown in FIG. 5, a gear 65, to which is applied a driving force from the laser printer 1 body, is provided on the outer surface of the casing end wall 51*a*, and the gears 67 and 66 fixed to the rotary shafts of the supply roller 58 and the developing roller 59 are configured in such a way that the driving force is directly transmitted to both of them from the gear 65. Also, the gear 63 fixed to the rotary shaft 55 of the agitator 80 is configured in such a way that the driving force from the gear 65 is transmitted in a decelerated condition via a change gear 68.

Consequently, when a driving force rotating clockwise as seen in FIG. 5 is applied to the gear 65, the supply roller 58, the developing roller 59 and the agitator 80 rotate in directions indicated by the arrows in FIG. 1.

Figure 4:
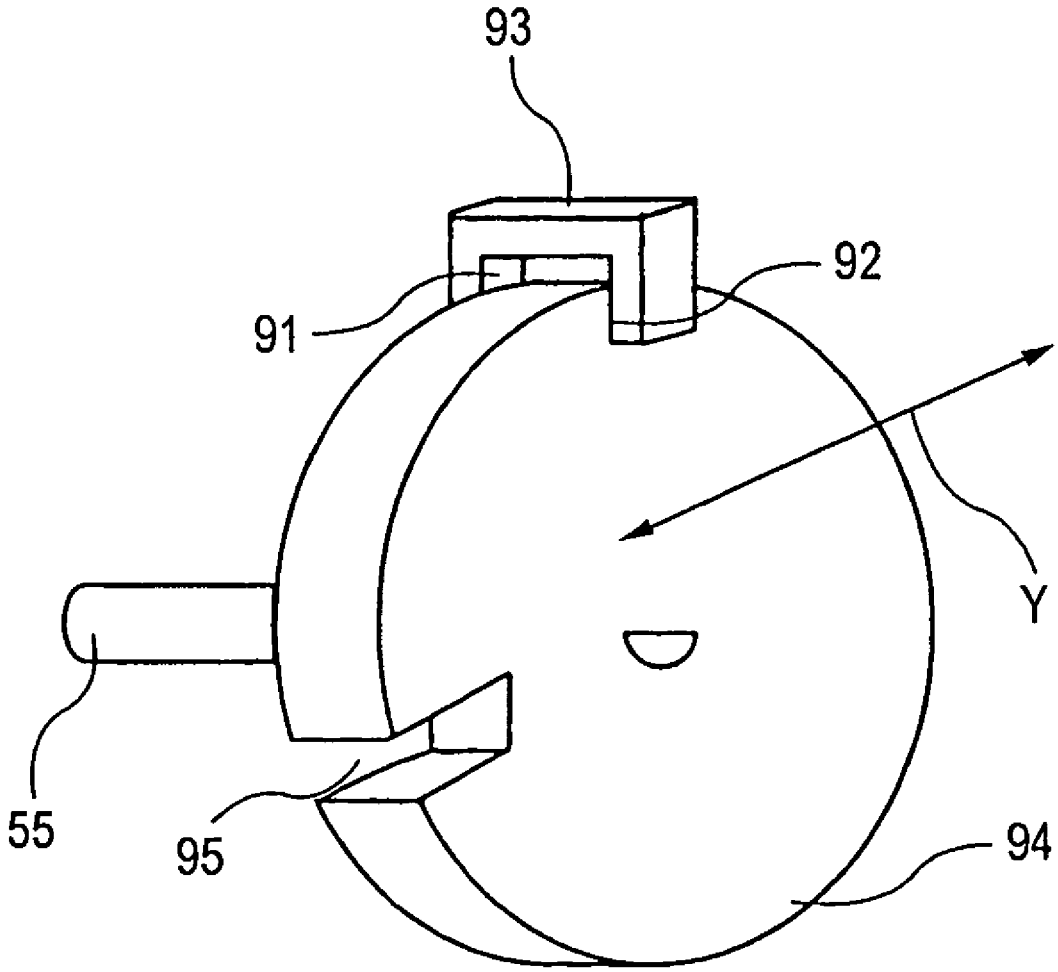
FIG. 4 is a perspective view showing a configuration of a detected portion and a detector portion.

Next, a description will be given of the detector portion 93 provided in the laser printer 1 and the detected portion 94 provided at the driven end of the rotary shaft 55. FIG. 4 is a perspective view showing a configuration of the detector portion 93 and the detected portion 94.

The detector portion 93, being formed as a squared U-section shape, is an optical sensor (herein, a photo sensor) formed by a light emitting portion (for example, a light emitting diode) and a light receiving portion 92 (for example, a phototransistor), and the light emitting portion 91 and the light receiving portion 92 are attached to opposite ends of the squared U-section shape.

An opening portion of the detector portion 93 is disposed facing a bottom of the laser printer 1 in such a way that the detected portion 94 does not interfere with the detector portion 93 when attaching the developing cartridge 50 to the laser printer 1 body (in the same way also as in the case of attaching the drum cartridge having attached thereto the developing cartridge).

Also, the detected portion 94, being a member made of a circular thin plate, is fixed to the rotary shaft 55 in such a way as to be driven under a rotating force of the rotary shaft 55.

The detected portion 94 is configured in such a way as to be sandwiched between the light emitting portion 91 and the light receiving portion 92 of the detector portion 93 when the developing cartridge 50 attached to the drum cartridge 5 is attached to the laser printer 1 body (the developing cartridge 50 (that is, the detected portion 94) is attached and detached in a direction of an arrow Y shown in FIG. 4).

Furthermore, the detected portion 94 has a notch 95 provided in a position which is detected by the sensor, that is, a portion which corresponds to a path extending from the light emitting portion 91 toward the light receiving portion 92. That is, a configuration is such that light emitted from the light emitting portion 91 of the sensor passes through the notch 95 and is detected in the light receiving portion 92 of the sensor.

That is, the light emitted from the light emitting portion 91 is turned ON when it passes through the notch 95 of the detected portion 94 and can be received by the light receiving portion 92, while the light is turned OFF when it is blocked by the thin plate and cannot be received by the light receiving portion 92. For this reason, for example, when a notch 95 such as the one shown in FIG. 10A is formed in the detected portion 94, a pulse waveform such as the one shown in FIG. 11A can be obtained as a detection signal.

Figure 10A:
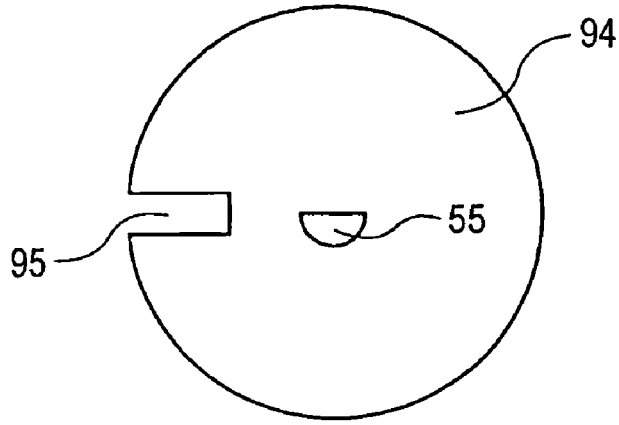
FIGS. 10A to 10C are illustrations showing shapes of a notch.
Figure 10B:
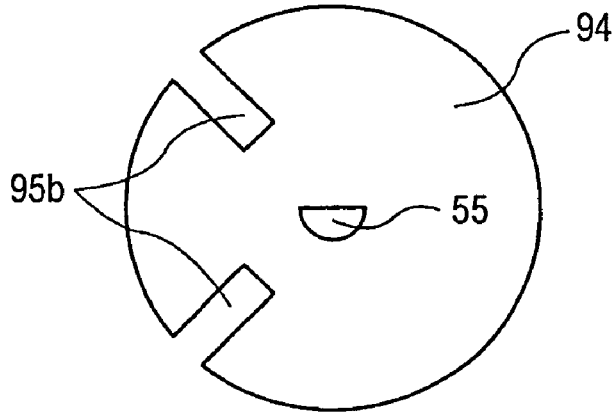
Figure 10C:
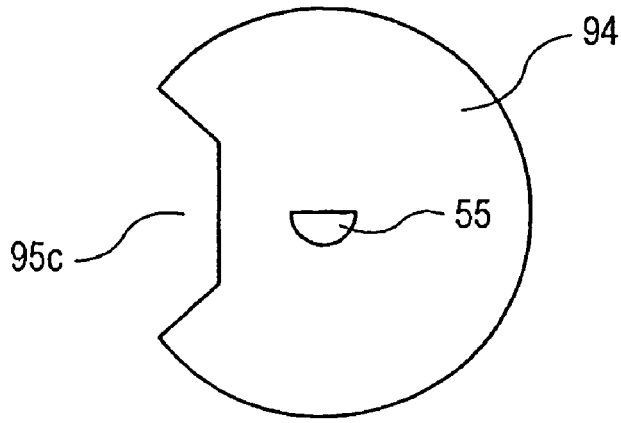
Figure 11A:
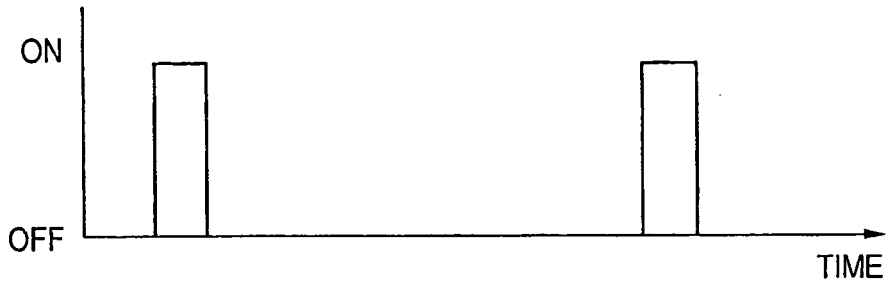
FIGS. 11A to 11C are illustrations of pulse waveforms.
Figure 11B:
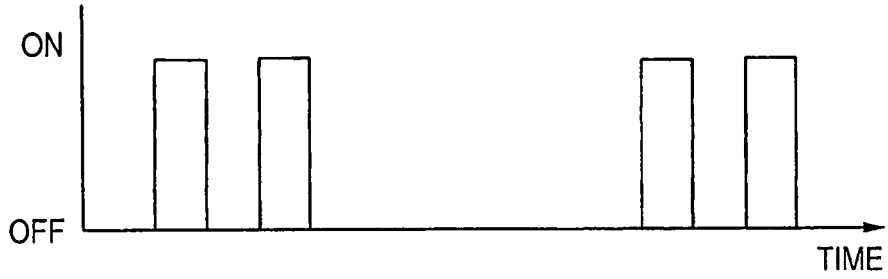
Figure 11C:
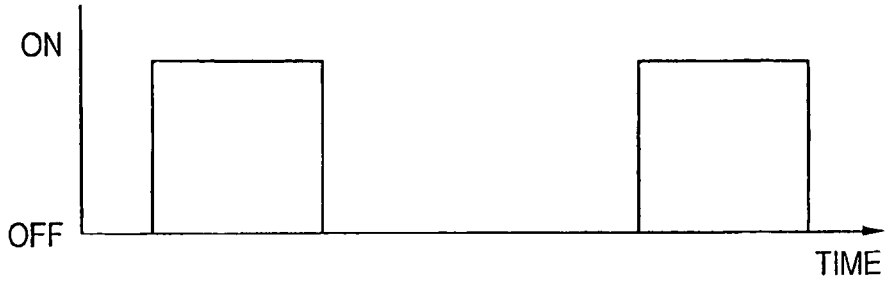

FIGS. 10A to 10C are illustrations regarding shapes of the notch 95 in the detected portion 94, and FIGS. 11A to 11C are illustrations of pulse waveforms obtained as a result of a detection of the detected portion 94 by the detector portion 93.

Consequently, by changing the shape and number of notches 95 formed in the detected portion 94, it is possible to obtain different patterns of pulse waveform. That is, in this aspect, the number of notches 95 is changed (to two) according to an initial amount of toner loaded in the developer container 52. For example, by forming one notch 95 in the detected portion 94 as shown in FIG. 10A, it is possible to produce the pulse waveform in FIG. 11A which can be obtained in a case in which a developing cartridge having a small initial loading amount of toner has been attached. By forming two notches 95*b* in the detected portion 94 as shown in FIG. 10B, it is possible to produce the pulse waveform in FIG. 11B which can be obtained in a case in which a developing cartridge having a large initial loading amount of toner has been attached. Although the number of notches 95 is changed according to the initial loading amount of toner at this point, it is also acceptable to change the shape of the notch 95. For example, by increasing the width of a notch 95*c* as shown in FIG. 10C, it is possible to produce the pulse waveform in FIG. 11C which can be obtained in the case in which the developing cartridge having the large initial loading amount of toner has been attached.

As the detector portion 93 is disposed in the laser printer 1 body, it is necessary that the detected portion 94 be positioned outside the drum cartridge 5. For this reason, a groove (a guide rail 85), which is used to prevent the developing cartridge 50 from interfering with the rotary shaft 55 when attaching and detaching the developing cartridge 50 and thus facilitate the attachment and detachment of the developing cartridge 50, is formed in a portion of the drum cartridge 5 on the driven end side of the rotary shaft 55 provided with the detected portion 94.

<Description of Operation Control>

Figure 6:
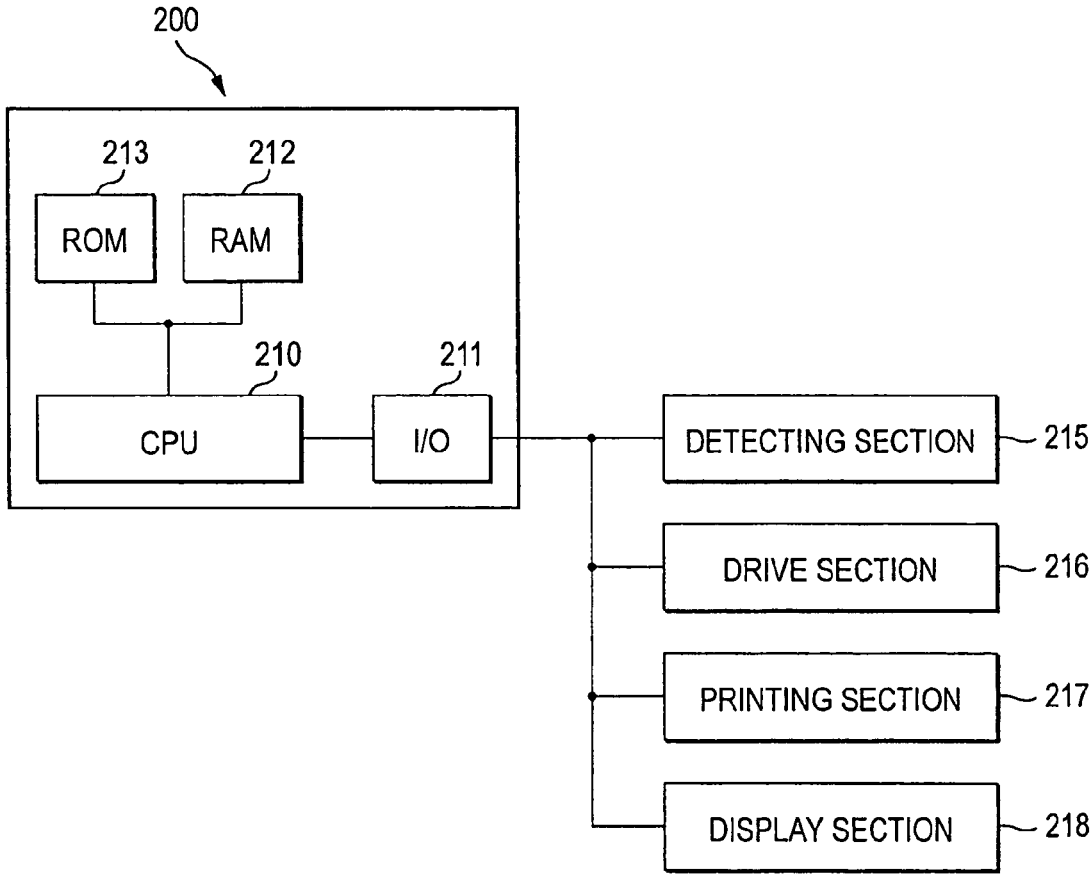
FIG. 6 is a block diagram showing a configuration of a controller.

FIG. 6 is a block diagram showing a configuration of a control system of the laser printer 1.

As shown in FIG. 6, the control system of the laser printer 1 is configured around a controller 200 including a well-known microcomputer equipped with an ROM 213 storing various control programs, an RAM 212 storing information obtained from each section, a CPU 210 which executes a control over each section based on the programs stored in the ROM 213, and an input/output interface (hereafter referred to as an I/O 211) in charge of providing communication between each section and the CPU 210

The CPU 200 is connected via the I/O 211 to sections, such as a detection section 215 acting as a circuit of the detector portion 93 which detects an operating condition of the detected portion 94, a drive section 216 for transmitting the driving force to the gear 65 of the developing cartridge 50, a printing section 217 for processing a series of printing operations ranging from an emitting of the laser beam to a printing on the sheet of paper, and a display section 218 for notifying a user of a variety of information. The sections are controlled by the controller 200.

Figure 7:
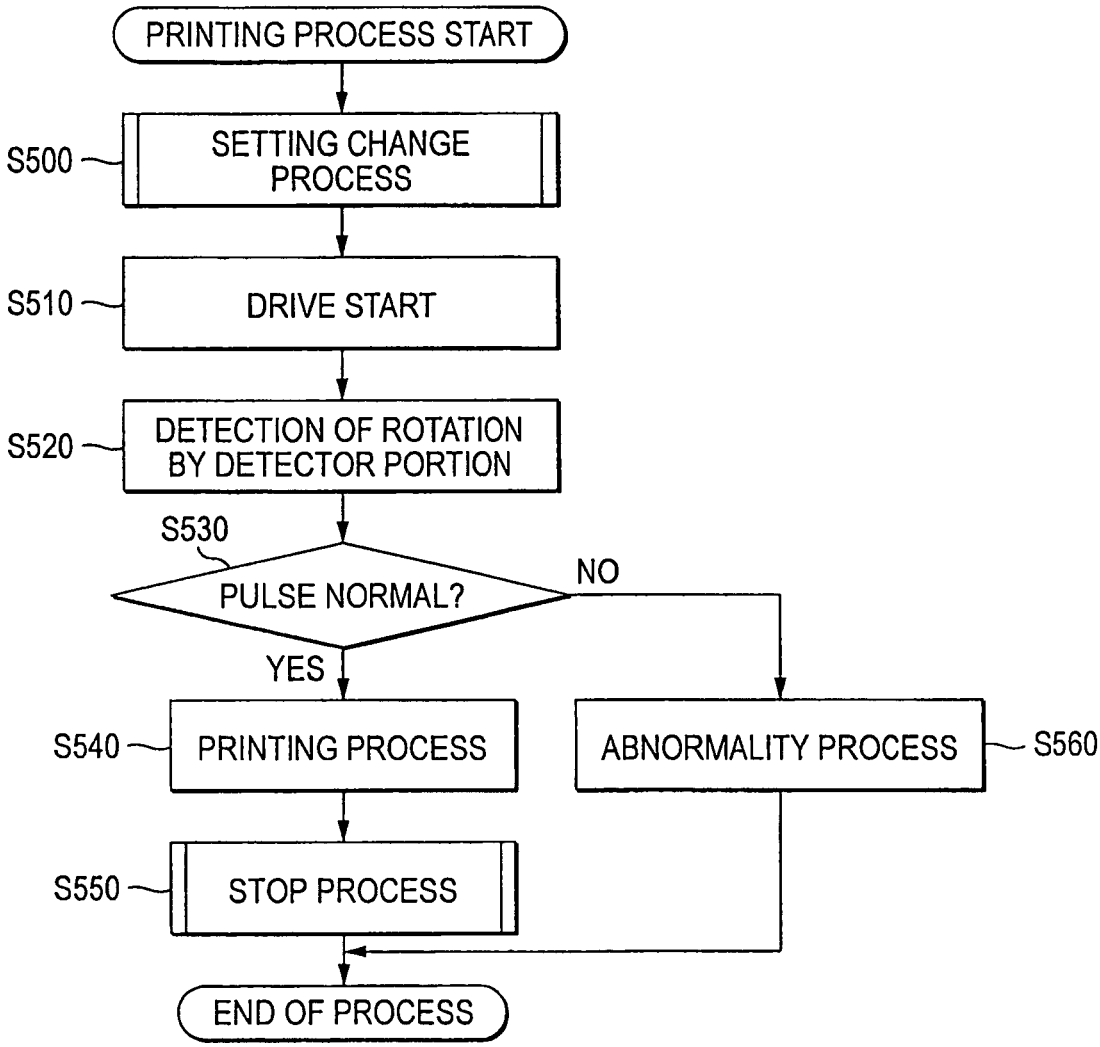
FIG. 7 is a flowchart of a printing process.

A printing process executed by the CPU 210 of the laser printer 1 will be described using a flowchart in FIG. 7.

When the printing process is started, first, in S500, it is determined whether or not the developing cartridge 50 has been replaced, and a setting change process is executed in which various settings are changed in accordance with an initial developer loading amount contained in a developing cartridge.

After the setting change process is carried out, in S510, a command to drive the gear 65 of the developing cartridge 50 is transmitted to the drive section 216. Based on the command, the driving force is transmitted to the gears 63, 66 and 67 via the gear 65, thereby rotating the agitator 80 (the rotary shaft 55), the supply roller 58 and the developing roller 59.

Subsequently, in S520, a detection signal is obtained by causing the detection section 215 to detect a rotary condition of the rotary shaft 55. In S530, by comparing a pulse waveform of the detection signal obtained in S520 and a pulse waveform which, being obtained in a normal rotary condition, is stored in advance in the ROM 213, it is determined whether or not there is an abnormality. As used herein, the abnormality refers to a case in which the rotation of the rotary shaft 55 is stopped and no pulse waveform can be obtained (that is, no detection signal can be obtained), a case in which a cycle of the pulse waveform significantly exceeds a prescribed range set in advance, and a like case.

Then, when there is the abnormality in the pulse waveform as a result of the determination in S530, as the rotary shaft 55 is broken in the vicinity of the drive end of the rotary shaft 55 which is provided with the gear 63 (the breaking, including a fracture of the rotary shaft, refers to a condition in which the rotary shaft cannot rotate normally), the driving force is not transmitted to the driven end side of the rotary shaft 55 which is provided with the detected portion 94, so that it is determined that the detected portion 94 is not rotating normally.

In this case, in the next S560, in order to prompt the user to replace the developing cartridge 50 by notifying him/her that the abnormality has occurred in the rotary shaft 55 of the agitator 80, an abnormality process is carried out for causing the display section 218 to display the occurrence of the abnormality. Furthermore, in the abnormality process, an operation of the drive section 216 is limited in such a way that the driving force is not transmitted from the laser printer 1 body to the developing cartridge 50.

In the case of limiting the operation of the drive section 216, it is acceptable to stop the operation of the printing section 217 after stopping the drive of the drive section 216 immediately after recognizing the breaking of the rotary shaft 55, or it is also acceptable to stop the operation of the printing section 217 after stopping the drive of the drive section 216 after causing the printing section 217 to print a certain number of copies.

Also, if the detection result obtained in S520 shows a normal pulse waveform as a result of the determination in S530, the process moves to S540, wherein the printing section 217 is caused to carry out a normal printing operation as a printing process. In the printing process, information on a use period of the developing cartridge 50 (that is, a period in which the developing cartridge 50 can be used without toner deterioration) is constantly updated (reduced) in accordance with the number of copies printed and the number of revolutions of the rotary shaft 55.

Subsequently, in S550, a stop process is carried out in which the agitation portion 53 of the agitator 80 is stopped in a stop position which is preset in such a way as to prevent the agitation portion 53 from remaining under a pressure of the toner during the stopping of the drive.

After that, the printing process is finished.

Figure 8:
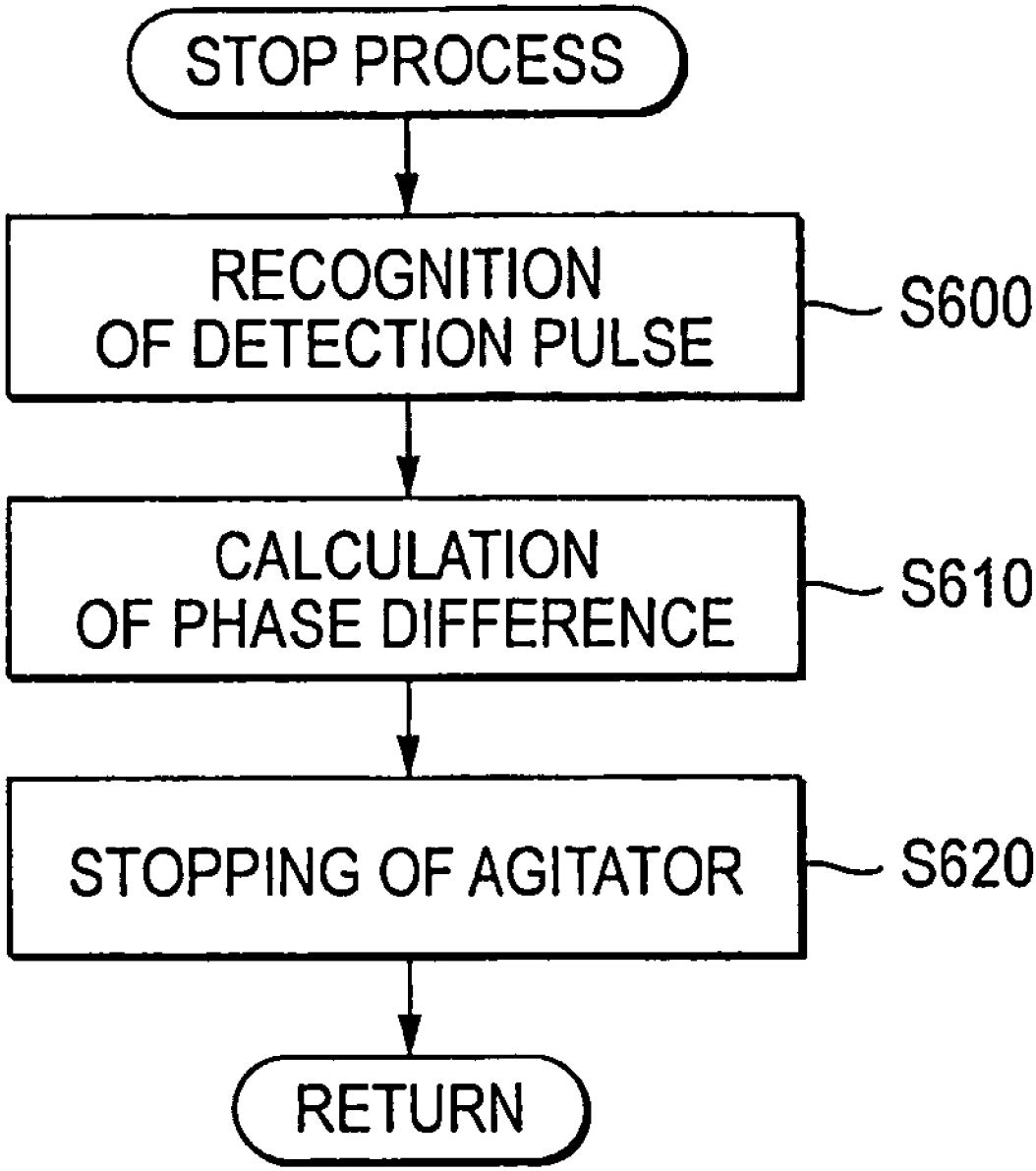
FIG. 8 is a flowchart of a stop process.

Next, the stop process in S550 in the printing process will be described using a flowchart shown in FIG. 8.

In the stop process, first, in S600, the detection section 215 is caused to detect the rotary condition of the rotary shaft 55, thereby obtaining a detection signal.

Then, in S610, a timing, at which a rotation phase of the rotary shaft 55 falls in a preset reference phase, is extracted from the detection signal obtained in S600.

In the next S620, based on the timing extracted in S610, by transmitting a command to stop the drive of the gear 65 to the drive section 216 at the time a preset drive time has elapsed, the agitation portion 53 of the agitator 80 is stopped in a preset stop position (that is, the cleaning portion 54 also stops in a preset position).

After that, the process is returned to the printing process, and all the processes are finished.

The stop position refers to a position which prevents the agitation portion 53 and the cleaning portion 54 from remaining in contact with the toner during the stopping of the drive, and a position in which the agitation portion 53 and the cleaning portion 54 do not overlap the loading hole formed in the developing cartridge 50.

That is, as a relationship between the rotation phase of the rotary shaft 55 corresponding to the stop position and the reference phase is known, a drive time necessary for causing the agitator 80 to stop in the stop position is easily calculated from a drive condition (a rotation speed and the like) of the rotary shaft 55. Consequently, it is sufficient that, for example, a table, which has the drive condition (the rotation speed and the like) of the rotary shaft 55 related to the drive time calculated from the drive condition, is stored in advance in the ROM 213, and that the drive time is set in accordance with the table and the drive condition of the rotary shaft 55 at that time.

Figure 9:
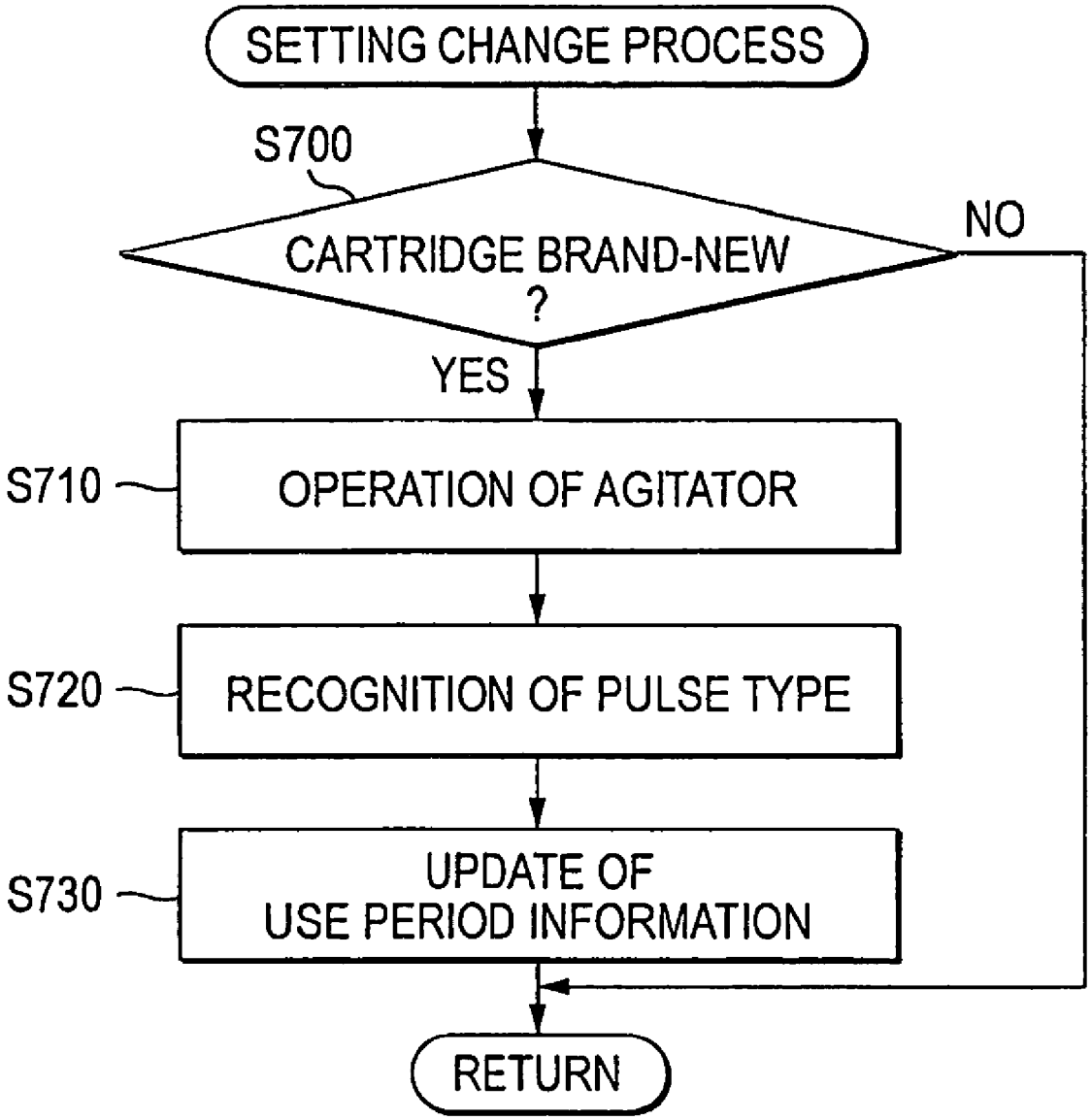
FIG. 9 is a flowchart of a setting change process.

Next, the setting change process of S500 in the printing process will be described using a flowchart shown in FIG. 9.

First, when the setting change process is executed, in S700, it is determined whether or not a newly attached developing cartridge 50 is brand-new. This determination is carried out by a not-shown movable detection gear attached to the developing cartridge 50. Specifically, when the brand-new developing cartridge 50 is attached to the laser printer 1, the detection gear moves, and a detection lever operates along with the movement of the gear. The movement of the detection lever is detected by the sensor, thereby determining whether or not the developing cartridge 50 is brand-new.

As the detection as to whether or not the cartridge is brand-new is a publicly known art, a further description will be omitted (for example, refer to JP-A-2005-55544).

After that, if a result of the determination in S700 is that the newly attached developing cartridge 50 is not brand-new (for example, if the developing cartridge detached before is attached again), the process returns to the printing process as it is, and then moves to S510 in the printing process.

On the other hand, if a result of the determination in S700 is that the newly attached developing cartridge 50 is brand-new, a command to drive the gear 65 of the developing cartridge 50 is transmitted to the drive section 216. Based on the command, the driving force is transmitted to the gears 63, 67 and 66 via the gear 65, thereby rotating the agitator 80 (the rotary shaft 55), the supply roller 58 and the developing roller 59.

Then, the detection section 215 is caused to detect the rotary condition of the rotary shaft, thereby obtaining a detection signal.

In the next S720, by comparing a pulse waveform of the detection signal obtained in S710 and a plurality of kinds of pulse waveform which has been stored in advance in the ROM 213 and prepared in accordance with the initial toner loading amount of the developing cartridge 50, the type (that is, the initial toner loading amount) of the newly attached developing cartridge 50 is identified (refer to FIGS. 11A, 11B and 11C).

In the next S730, the information on the use period of the developing cartridge 50 (that is, the period of time for which the developing cartridge 50 can be used without toner deterioration), which has been stored in the ROM 213, is initialized as contents corresponding to the developing cartridge 50 identified in S720.

After that, the process returns to the printing process and then moves to S510.

S560 in the printing process corresponds to the abnormal stop means of the invention, S620 in the stop process corresponds to the stop control means of the invention, S700 in a cartridge replacement process corresponds to the use detection means of the invention, and S730 corresponds to the use period setting means of the invention.

<Advantageous Effects of this Aspect>

As described heretofore, in the laser printer 1 (the developing cartridge 50) of this aspect, the detected portion 94 for causing the detector portion 93 to detect the rotary condition of the rotary shaft 55 (and thus the agitator 80) is provided not on the drive end side of the rotary shaft 55, but on the driven end side of the rotary shaft 55.

For this reason, in the event that the rotary shaft 55 is broken in the vicinity of a gear setting portion on the drive end side of the rotary shaft 55 (the breaking of the rotary shaft 55, including a fracture of the rotary shaft, refers to the condition in which the rotary shaft cannot rotate normally), the rotary condition of the rotary shaft 55 which is detected by the detector portion 93 via the detected portion 94 becomes different from an expected operation of the detected portion 94.

Consequently, according to the laser printer 1 of this aspect, it is possible to reliably detect the abnormality of the agitator 80 (the breaking of the rotary shaft 55) from a result of the detection in the detector portion 93.

Also, in the event that the abnormality of the agitator 80 has been detected, as the drive of the developing cartridge 50 is stopped and an unnecessary printing process is not carried out, it is possible to suppress a defective printing.

Also, in the laser printer 1 of this aspect, the detection signal obtained from the detector portion 93 has a pulse waveform corresponding to the shape and number of notches 95 in the detected portion 94, and a configuration is such that the timing at which the rotary shaft 55 falls in the reference phase can be specified based on a pulse generating timing, and such that the initial loading amount of toner can be specified from a pulse pattern.

Consequently, according to the laser printer 1 of this aspect, when the operation of the developing cartridge 50 is stopped, the agitator 80 can be stopped in an appropriate stop position in which the pressure from the toner is prevented from being applied to the agitation portion 53, and furthermore which does not overlap the loading hole 81.

As a result, as a deformation of the agitator 80 due to the pressure from the toner is prevented, as well as being able to lengthen a useful life of the agitator 80, when a toner loading is required, it is possible to smoothly insert the loading nozzle into the loading hole 81 and easily load the developing cartridge 50 with the toner.

Also, according to the laser printer 1 (the developing cartridge 50) of this aspect, as a configuration is such that, in the event that the replacement of the developing cartridge 50 is detected, the use period of the developing cartridge 50 is set in accordance with the pulse waveform pattern of the detection signal obtained from the detector portion 93, it is possible to prevent a printing with a deteriorated toner and, as a result, suppress a defective printing.

Also, in the laser printer 1 of this aspect, as the detector portion 93 is disposed in such a way as not to interfere with the detected portion 94, it is possible to prevent a deterioration and a failure due to a contact and lengthen the useful life. Also, even when the developing cartridge 50 is attached and detached, as the detector portion 93 does not make contact with the detected portion 94, the developing cartridge 50 can be easily attached and detached without wasting a user's time.

Also, according to the laser printer 1 of this aspect, as a photo sensor is employed as the detector portion 93, even in the event that a magnetic toner is in use, it will not affect the detection result of the detector portion 93, and it is possible to reliably detect the rotary condition of the rotary shaft 55.

[Another Aspect]

Next, a description will be given of a second aspect.

Although a monochromatic laser printer has been described in the above-described one aspect, a color laser printer using a plurality of colors will be described in this aspect.

Figure 12:
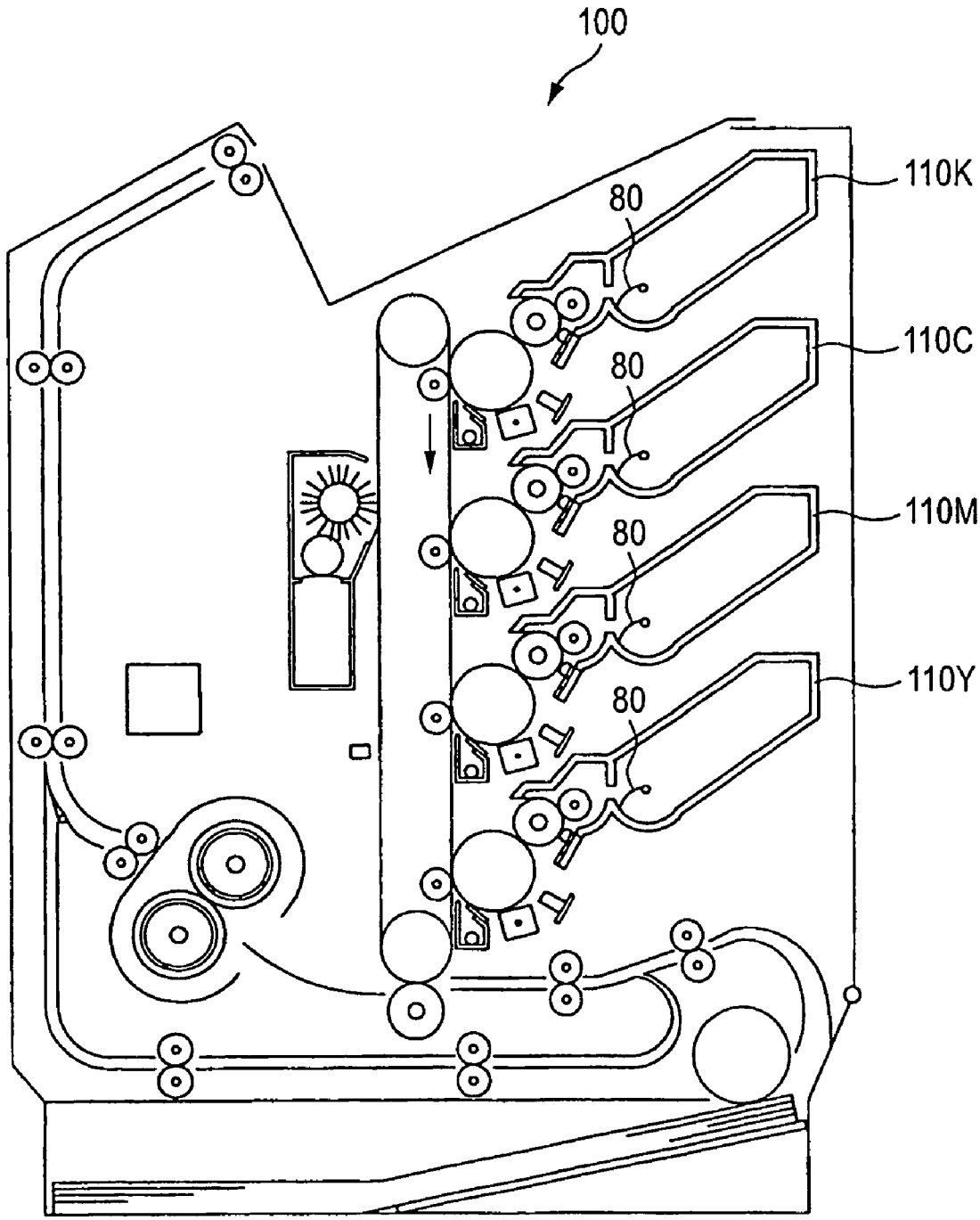
FIG. 12 is a sectional view showing an outline of a color laser printer.

As shown in FIG. 12, a color laser printer 100 (hereafter referred to as a printer body) of this aspect is a well-known one equipped with four kinds of developing cartridge 110, a developing cartridge 110K loaded with a toner whose color is black, a developing cartridge 110C loaded with a toner whose color is cyan, a developing cartridge 110M loaded with a toner whose color is magenta, and a developing cartridge 110Y loaded with a toner whose color is yellow.

That is, the printer body 100 is formed with four attaching portions to each of which a developing cartridge 110 is detachably attached, and quite the same detector portion (sensor) as that of the above one aspect is disposed in each of the attaching portions. Also, attachment positions of the developing cartridges 110K, 110C, 110M and 110Y are predetermined.

Also, the developing cartridges 110K, 110C, 110M and 110Y are configured in the same way as the developing cartridge 50 of the above one aspect, apart from detected portions.

That is, the shape and number of notches formed in each of the detector portions are set in such a way that the developing cartridges 110K, 110C, 110M and 110Y can obtain pulse waveforms shown in FIGS. 14A, 14B, 14C and 14D from the detector portions, respectively.

Also, as the printer body 100 is also arranged in the same way as the laser printer 1 of the above one aspect except that a plurality of components corresponding to the developing cartridge 110 exists, a description will be omitted herein. The same components as those of the above one aspect will be described using identical reference numerals.

Figure 13:
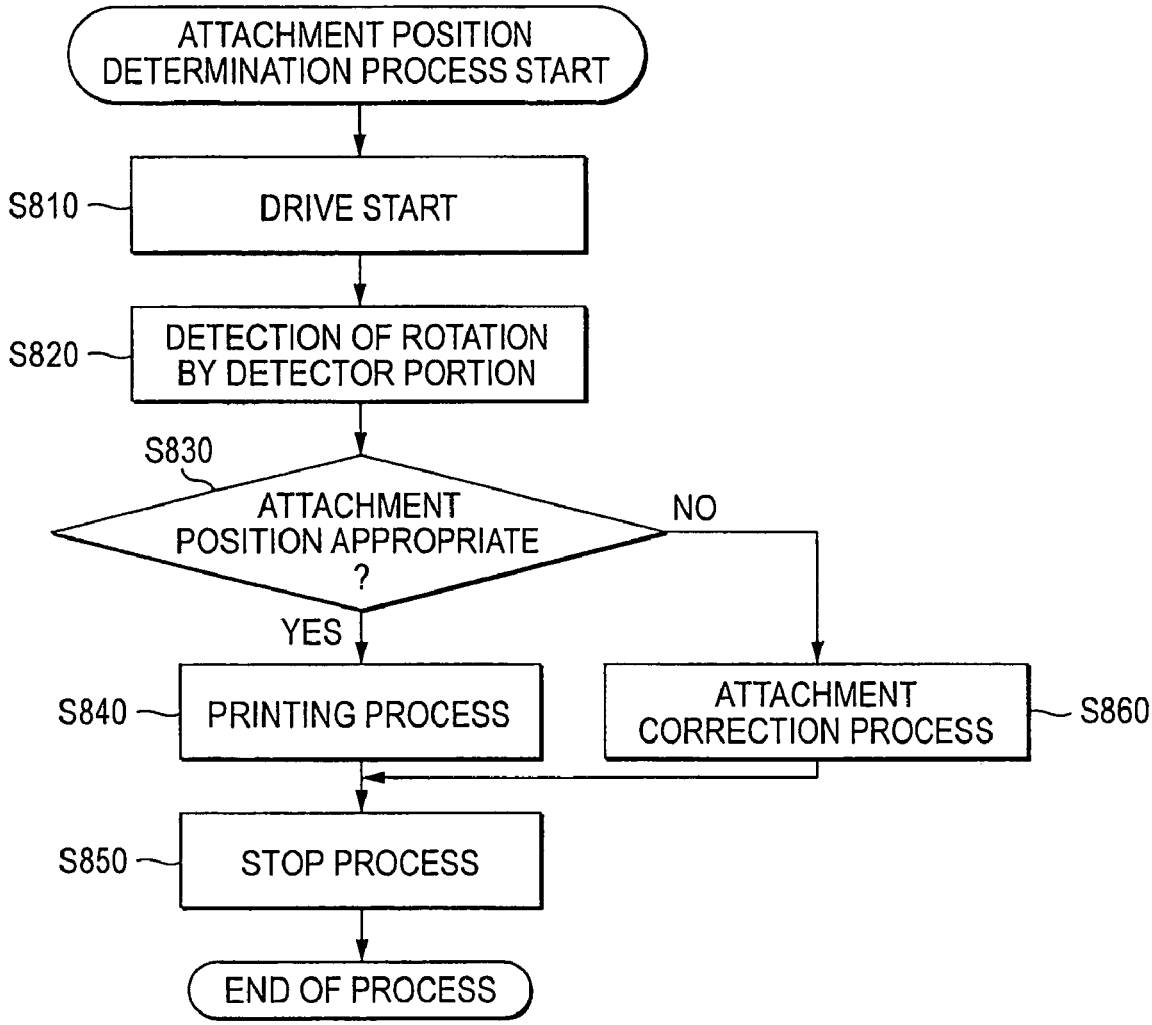
FIG. 13 is a flowchart of an attachment position determination process.
Figure 14A:
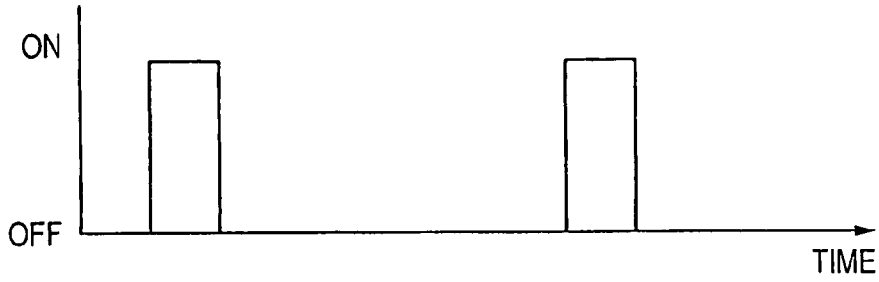
FIGS. 14A to 14D are illustrations of pulse waveforms differing according to a toner color.
Figure 14B:
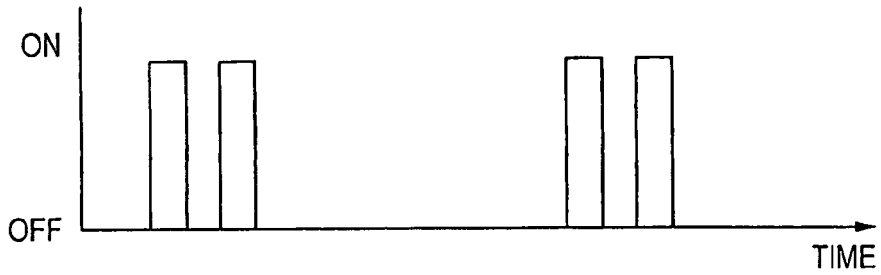
Figure 14C:
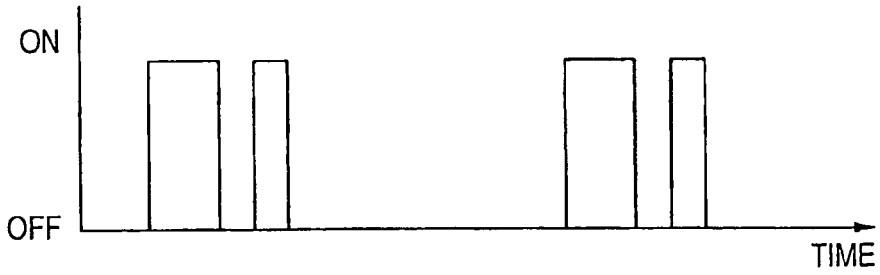
Figure 14D:
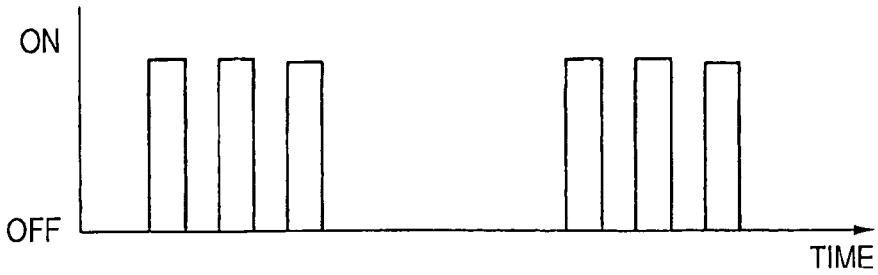

At this point, an attachment position determination process executed by the controller 200 of the printer body 100 will be described in accordance with a flowchart shown in FIG. 13.

When the attachment position determination process is started, first, in S810, a command to drive the gear 65 of the developing cartridge 50 is transmitted to the drive section 216. Based on the command, the driving force is transmitted to the gears 63, 66 and 67 via the gear 65, thereby rotating the agitator 80 (the rotary shaft 55), the supply roller 58 and the developing roller 59.

Subsequently, in S820, the detection section 215 is caused to detect the rotary condition of the rotary shaft 55, thereby obtaining a detection signal.

In S830, it is determined whether or not a pulse waveform of the detection signal obtained in S820 conforms to a pulse waveform which is preset for a cartridge attaching portion to which the relevant developing cartridge is attached. That is, in S830, it is determined whether or not a toner color of a developing cartridge 110 attached to a cartridge attaching portion conforms to a toner color which is specified in advance for the cartridge attaching portion.

As a result of the determination in S830, if a toner color of a developing cartridge 110 attached to a cartridge attaching portion does not conform to a toner color which is specified in advance for such a cartridge attachment portion, the process moves to S860.

In S860, in order to prompt the user to attach an appropriate developing cartridge 110 again, an attachment correction process is carried out in which the display section 218 is caused to display the fact that the developing cartridge attached to the cartridge attaching portion is wrong. After that, the process moves to S850.

However, if, in S830, a toner color of a developing cartridge 110 attached to a cartridge attaching portion conforms to a toner color which is specified in advance for such a cartridge attachment portion, a printing process is carried out in S840.

Then, after a stop process is carried out in the next S850, this process is finished.

The printing process in S840 is the same as the heretofore described printing process in S540, and the stop process in S850 is the same as the stop process in S550 (S600 to S620).

With the thus configured developing cartridge 110 and printer body 100, a wrong color developing cartridge 110 can be prevented from being attached. As a result, it is possible to suppress an occurrence of a defective printing.

[Other Aspects]

Although the aspects of the invention have been described so far, the invention is not limited to the aspects, but can be practiced in various modes without departing from the scope of the invention.

Figure 15:
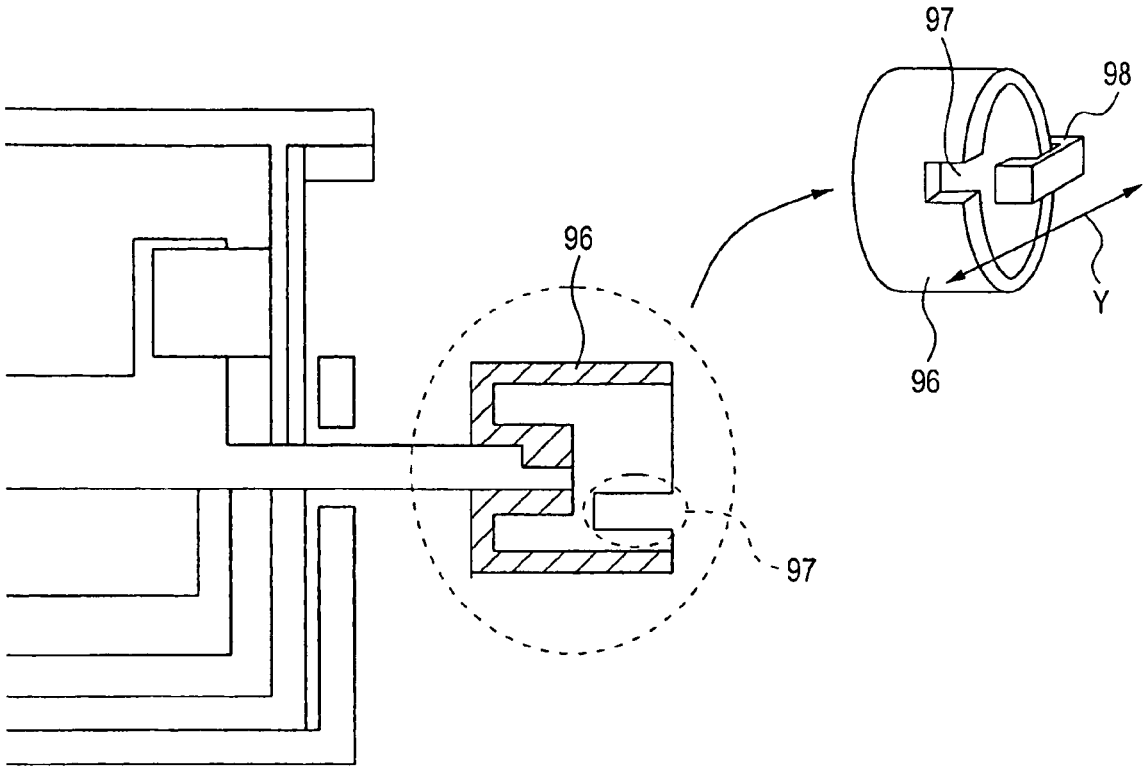
FIG. 15 is a perspective view showing a modified example of the detected portion.

In the aspects, the detected portion 94 is formed from a circular thin plate but, without being limited thereto, may be a detected portion 96 such as the one shown in FIG. 15.

In this case, the detected portion 96 includes a portion to be fixed to the rotary shaft and a cylindrical portion which, projecting from an edge of the circular thin plate, is detected by a detector portion 98. The detector portion 98 has the same configuration as the detector portion 93 of the above one aspect. Then, the cylindrical portion is formed with a notch 97 for causing the detector portion 98 to detect the rotary condition of the rotary shaft.

In a case of employing such a detected portion 96, in order to prevent the detected portion 96 from interfering with the detector portion 98 during the attachment and detachment of the developing cartridge (the developing cartridge (that is, the detected portion 96) is attached and detached in a direction of the arrow Y shown in FIG. 15), the detector portion 98 is preferably of a movable structure in such away that it can retract from and return to a normal position crossing a movement path of the detected portion 96.

Also, although the detected portion 94 is formed with the notch 95 for obtaining a pulse waveform, a hole formed passing through the detected portion 94 is also acceptable. It is also acceptable that a light emitting portion 91 and a light receiving portion 92 of the detector portion 98 are disposed on the same surface side of the detected portion 94, and that a strip of a member which reflects light like a mirror is fixed to the detected portion 94. That is, any structure is acceptable so long as it can detect a pulse waveform of a constant frequency from the rotary condition of the rotary shaft 55.

Also, although, in the aspects, a photo sensor is employed as the detector portion 93, it is also acceptable to detect the rotary condition of the rotary shaft using a magnetic sensor.

Although, in the aspects, the agitator 80 and the detected portion 94 are structured in such a way that they are formed as separate members and integrally fixed afterward, it is also acceptable that they are integrally molded in advance.

What is claimed is:

1. A developing cartridge comprising:

a developer container that contains a developer;

a developer carrier that carries the developer;

an agitation member that comprises a rotary shaft, agitates the developer in the developer container and supplies the developer to the developer carrier;

a drive member that is fixed at one end of the rotary shaft and configured to directly transmit a driving force to the rotary shaft; and a detected portion that is provided at the other end of the rotary shaft and comprises a phase information provision portion that contributes to detect that a rotation phase of the rotary shaft falls in a preset reference phase.

2. The developing cartridge according to claim 1, wherein the developing cartridge is configured to be installed in an image forming apparatus comprising a detector, and wherein the detected portion is detected by the detector when the developing cartridge is installed in the image forming apparatus.

3. The developing cartridge according to claim 1, wherein the detected portion is a rotary member that is rotated by a rotation of the rotary shaft.

4. The developing cartridge according to claim 1, wherein the detected portion is integrally formed with the rotary shaft.

5. The developing cartridge according to claim 1, wherein the detected portion comprises a loading amount information provision portion that contributes to detect detection signals differing according to an initial loading amount of the developer contained in the developer container.

6. The developing cartridge according to claim 1, wherein the detected portion comprises a type information provision portion that contributes to detect detection signals differing according to a type of the developer contained in the developer container.

7. The developing cartridge of claim 1, wherein the agitation member includes a cleaning portion that cleans a portion of the developer container, and the developer container includes a pair of light transmission windows, the cleaning portion cleaning the light transmission windows.

8. The developing cartridge of claim 7, wherein the cleaning portion includes a pair of wipers, each wiper positioned to clean one of the light transmission windows.

9. The developing cartridge of claim 8, wherein the cleaning portion includes a pair of wiper supports, each wiper support connecting one of the wipers to the rotary shaft.

10. The cartridge according to claim 1, wherein the phase information provision portion has a slit that is formed in the detected portion unevenly around the shaft.

11. An image forming apparatus comprising:

a developing cartridge that comprises:

a developer container that contains a developer;

a developer carrier that carries the developer;

an agitation member that comprises a rotary shaft, agitates the developer in the developer container and supplies the developer to the developer carrier;

a drive member that is fixed at one end of the rotary shaft and configured to directly transmit a driving force to the rotary shaft; and a detected portion that is provided at the other end of the rotary shaft;

a drive section that supplies the driving force to the drive member;

a detector portion that detects a rotary condition of the rotary shaft via the detected portion; and a drive control section that controls an operation of the drive section when forming an image and comprises an abnormal stop section that stops the drive section if the operation of the drive section does not match with a result of the detection by the detector portion;

wherein the detected portion comprises a phase information provision portion that causes the detector portion to detect that a rotary phase of the rotary shaft falls in a preset reference phase, and the drive control section comprises a stop control section that, when stopping the operation of the drive section, stops the agitation member in a preset stop position by controlling the drive section based on the result of the detection by the detector portion in such a way that the rotary shaft stops at a stop phase having a predetermined relationship with the reference phase.

12. The image forming apparatus according to claim 11, wherein the developing cartridge has a loading hole that is for loading the developing cartridge with the developer and is provided on an end side of the rotary shaft of the agitation member, and the stop position is set outside an opening area of the loading hole in a direction along the rotary shaft of the agitation member.

13. The image forming apparatus according to claim 11, wherein the detected portion comprises a loading amount information provision portion that causes the detector portion to detect detection signals differing according to an initial loading amount of the developer contained in the developer container, and the image forming apparatus further comprises a use detection section that detects whether or not the developing cartridge is unused and a use period setting unit that, if a result of the detection by the use detection section is that the developing cartridge is unused, sets information on a use period of an attached developing cartridge in accordance with a pattern of the detection signal detected by the detector portion.

14. The image forming apparatus according to claim 11, wherein the detected portion comprises a type information provision portion that causes the detector portion to detect detection signals differing according to a type of the developer contained in the developer container, and the image forming apparatus further comprises a plurality of cartridge attaching portions which is provided according to the type of the developer and to each of which a developing cartridge is attached and an attachment position determination section that, in accordance with the pattern of the detection signal detected by the detector portion, determines whether or not the developing cartridge attached to the cartridge attaching portion is in an appropriate position.

15. The image forming apparatus according to claim 11, wherein the detector portion is used in a condition of non-contact with the detected portion.

16. The image forming apparatus according to claim 11, wherein a space on a movement path along which the detected portion moves when the developing cartridge is attached and detached is defined as a detected portion movement path, wherein the detector portion is disposed outside the detected portion movement path.

17. The image forming apparatus of claim 11, wherein the agitation member includes a cleaning portion that cleans a portion of the developer container, and the developer container includes a pair of light transmission windows, the cleaning portion cleaning the light transmission windows.

18. The image forming apparatus of claim 17, wherein the cleaning portion includes a pair of wipers, each wiper positioned to clean one of the light transmission windows.

19. The developing cartridge of claim 18, wherein the cleaning portion includes a pair of wiper supports, each wiper support connecting one of the wipers to the rotary shaft.

* * * * *

UNITED STATES PATENT AND TRADEMARK OFFICE

CERTIFICATE OF CORRECTION

PATENT NO. : 7,596,327 B2
APPLICATION NO. : 11/526599
DATED : September 29, 2009
INVENTOR(S) : Naoya Kamimura It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 62 days.

Signed and Sealed this

Twenty-eighth Day of September, 2010

David J. Kappos

David J. Kappos
*Director of the United States Patent and Trademark Office*